US006712292B1

(12) United States Patent
Gosis et al.

(10) Patent No.: US 6,712,292 B1
(45) Date of Patent: Mar. 30, 2004

(54) ADJUSTABLE ADAPTER FOR GRAVITY-FEED PAINT SPRAYER

(75) Inventors: Anatoly Gosis, Palatine, IL (US); Mark D. Bauer, Mount Prospect, IL (US); Marvin D. Burns, Millbury, OH (US); Mark E. Charpie, Lambertville, MI (US); Robert G. Kobetsky, Chicago, IL (US); Michael J. Kosmyna, Toledo, OH (US); Jan Toczycki, Chicago, IL (US); G. Michael Velan, Mount Prospect, IL (US)

(73) Assignee: Illinois Tool Works Inc., Glenview, IL (US)

( * ) Notice: Subject to any disclaimer, the term of this patent is extended or adjusted under 35 U.S.C. 154(b) by 25 days.

(21) Appl. No.: 10/458,548

(22) Filed: Jun. 10, 2003

(51) Int. Cl.[7] ..... B05B 7/30

(52) U.S. Cl. ..... 239/345; 239/346; 239/369; 239/375; 239/376; 239/377; 239/378; 239/379

(58) Field of Search ..... 239/302, 310, 239/315, 345, 346, 369, 375, 376, 377, 378, 379, DIG. 14; 285/190, 281, 273

(56) References Cited

U.S. PATENT DOCUMENTS

| | | | | |
|---|---|---|---|---|
| 4,978,072 | A | | 12/1990 | Kurowski |
| 5,069,389 | A | * | 12/1991 | Bitsakos ..... 239/345 |
| 5,415,352 | A | | 5/1995 | May |
| 5,655,714 | A | | 8/1997 | Kieffer et al. |
| 5,803,360 | A | | 9/1998 | Spitznagel |
| 5,810,258 | A | | 9/1998 | Wu |
| 5,918,815 | A | | 7/1999 | Wu |
| 5,984,206 | A | | 11/1999 | Leitzel et al. |
| 6,012,651 | A | | 1/2000 | Spitznagel |
| 6,053,429 | A | | 4/2000 | Chang |
| 6,092,740 | A | | 7/2000 | Liu |
| 6,213,410 | B1 | | 4/2001 | Spitznagel |
| 6,450,422 | B1 | | 9/2002 | Maggio |
| 6,536,684 | B1 | * | 3/2003 | Wei ..... 239/302 |

OTHER PUBLICATIONS

Hawk Hi–Tech Industries Inc., Advertising Flyer, "Professionbal Spray Guns For Paint & Body Shop".

* cited by examiner

*Primary Examiner*—Robin D. Evans
(74) *Attorney, Agent, or Firm*—Lisa M. Soltis; Mark W. Croll; Donald J. Breh

(57) ABSTRACT

An adjustable adapter includes two arms, each having an axis, a surface substantially normal to the axis, wherein the surfaces of the arms face each other, an end and a passageway for fluid communication between the end and the opening, wherein one of the arm ends is for connection to an inlet of an applicator and the other arm end is for connection to an outlet of a container, and a fastener for pivotally coupling the arms. One of the arm surfaces is provided with a groove in fluid communication with both arm openings. The groove is sealed to prevent fluid from leaking from between the surfaces. When the fastener is in a rotation-resisting mode, the fastener forces the surfaces of the arm toward one another sufficiently to increase friction and resist rotation therebetween, and when the fastener is in a rotation-permitting mode, the fastener releases the surfaces sufficiently to decrease friction and permit rotation therebetween.

6 Claims, 5 Drawing Sheets

ADJUSTABLE ADAPTER FOR GRAVITY-FEED PAINT SPRAYER

BACKGROUND OF THE INVENTION

1. Field of the Invention

The present invention is directed to an adapter for a fluid applicator, more particularly to an adjustable adapter for use with a gravity-feed paint sprayer.

2. Description of the Related Art

Fluids are commonly applied to surfaces with sprayers. For smaller applications, such as automobile painting and repainting in body shops, the fluid is generally placed in a cup attached to the sprayer. In one type of sprayer, the cup is suspended below a front end of the sprayer and the fluid is fed to a nozzle by suction induced by atomization air flow through the sprayer, usually referred to as a suction-feed sprayer. For viscous fluids and for sprayers operating at low air pressures, the cup may be pressurized to increase the fluid application rate. In a second type of sprayer, a cup is mounted above the sprayer body to feed the fluid via gravity to the sprayer so that less air pressure is needed to aspirate the paint, usually referred to as a gravity-feed sprayer.

It can be difficult for an operator to use a sprayer to spray paint upwards, particularly if a gravity-feed sprayer is being used, because the level of paint is subject to being below the level of the connection between the paint cup and the sprayer so that paint cannot flow into the sprayer via gravity, a condition known as starvation.

Attempts have been made to use an adapter that can be adjusted to different positions so that the paint cup can be moved into an upright position when the sprayer is tilted at various angles. Examples include U.S. Pat. No. 6,536,684 to Wei and U.S. Pat. No. 6,053,429 to Chang, both of which require an assembly of several complicated parts.

U.S. Pat. No. 5,803,360 to Spitznagel, particularly FIGS. 6 and 7, teaches a two piece adapter, wherein one piece is rotatable with respect to the other so that the orientation of the paint cup can be changed. However, it does not appear to teach a proper seal around the pivot screw, making it difficult to ensure that paint will not leak.

What is needed is an adjustable adapter for a fluid applicator that is uncomplicated and that effectively prevents fluid from leaking from the adapter.

BRIEF SUMMARY OF THE INVENTION

In accordance with the present invention, a novel adjustable adapter for connecting a container having an outlet and an applicator having an inlet is provided, wherein the novel adapter comprises a first arm having an axis, a surface normal to the axis with a fluid opening, an end for connection to the inlet of the applicator, and a passageway for fluid communication between the opening and the applicator, a second arm coaxial with the first arm having a surface normal to the axis with a fluid opening, wherein the second arm surface faces the first arm surface, an end for connection to the outlet of the container, and a passageway for fluid communication between the second arm surface opening and the container, a coaxial fastener for pivotally coupling the arms, wherein at least one of the surfaces is provided with a groove in fluid communication with the surface openings, the groove being sealed to prevent fluid from leaking from between said surface, and wherein, when in a rotation-resisting mode, the fastener forces the surfaces of the arms toward one another sufficiently to increase friction and resist rotation therebetween and, when in a rotation-permitting mode, the fastener releases the surfaces sufficiently to decrease friction and permit rotation therebetween.

These and other features and advantages are evident from the following description of the present invention, with reference to the accompanying drawings.

DETAILED DESCRIPTION OF THE INVENTION

Figure 1:
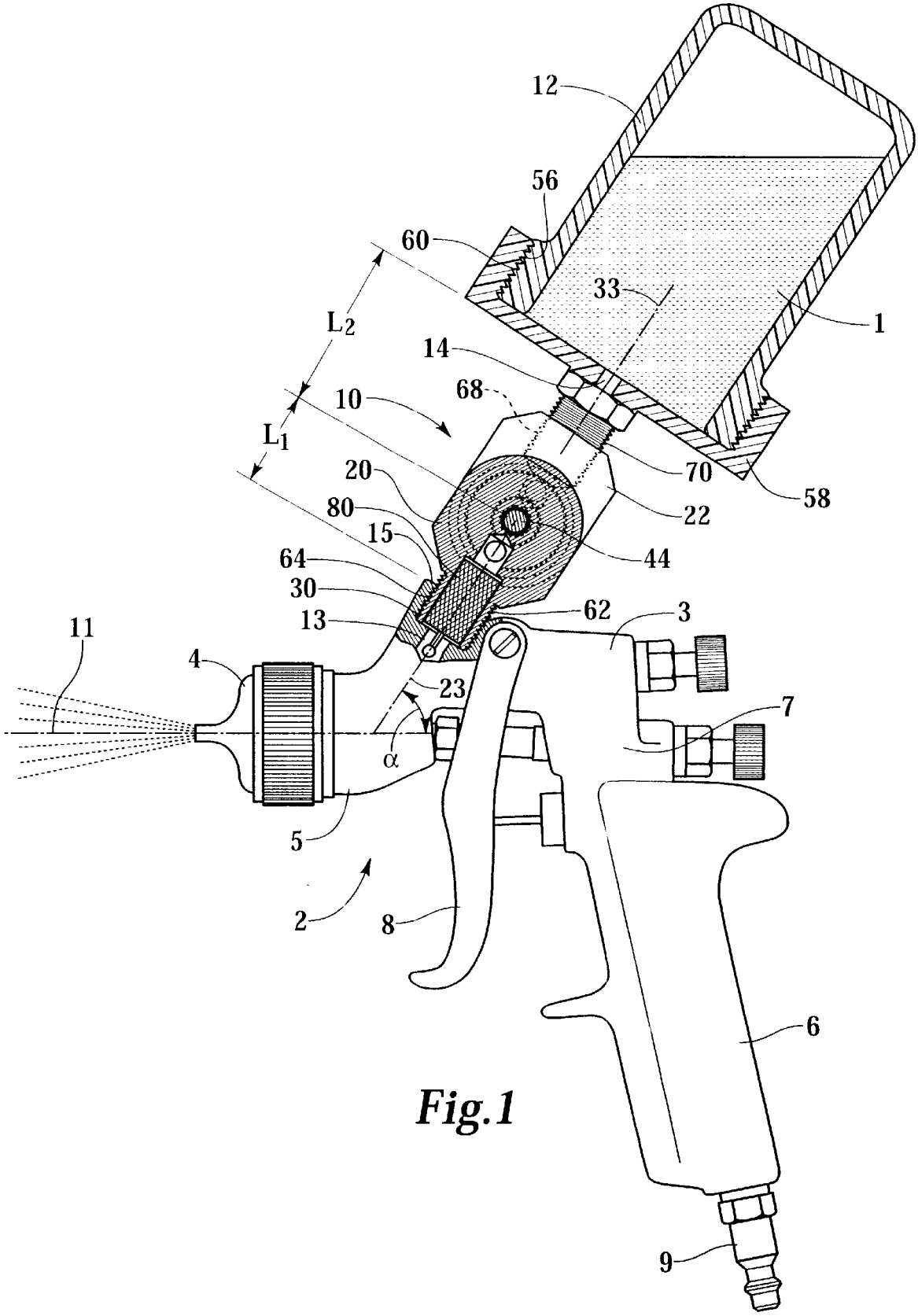
FIG. 1 is a partial side sectional view of the adjustable adapter of the present invention in a conventional mode engaged with a container and a paint sprayer.
Figure 3:
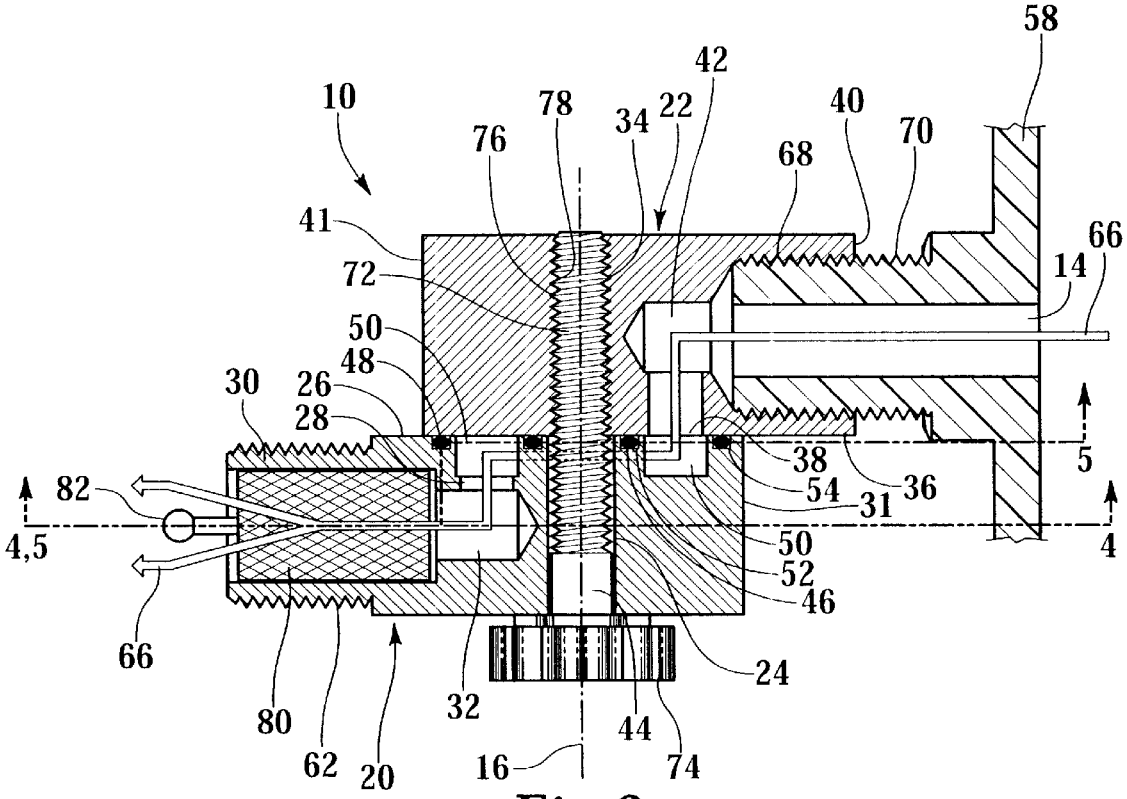
FIG. 3 is side sectional view of the adjustable adapter of the present invention.

Referring to FIGS. 1 and 3, an adjustable adapter 10 is shown for connecting a container 12 having an outlet 14 to a fluid applicator 2 having an inlet 13. The adjustable adapter 10 includes an applicator arm 20 having an axis 16, a surface 26 substantially normal to axis 16 with a fluid opening 28 in the surface 26, an end 30 for connection to fluid applicator inlet 13 and a passageway 32 for fluid communication between opening 28 and inlet 13 of fluid applicator 2, a container arm 22 coaxial with axis 16 of applicator arm 20 having a surface 36 substantially normal to axis 16 with an opening 38 in container arm surface 36, wherein container arm surface 36 faces applicator arm surface 26, an end 40 for connection to container outlet 14, and a passageway 42 for fluid communication between container arm opening 38 and outlet 14 of container 12, a fastener 44 for pivotally coupling applicator arm 20 and container arm 22.

At least one of the surfaces 26, 36 is provided with a groove 50 in fluid communication with surface openings 28, 38, wherein groove 50 is sealed, such as with seals 46, 48, to prevent fluid from leaking from between surfaces 26, 36. Fastener 44 forces surfaces 26, 36 toward one another sufficiently to increase friction, resisting rotation between arms 20, 22 when fastener 44 is in a rotation-resisting mode, and fastener 44 releases surfaces 26, 36 sufficiently to decrease friction and permit rotation between applicator the arms 20, 22 when fastener 44 is in a rotation-permitting mode.

In a preferred embodiment, adjustable adapter 10 is used for with a liquid applicator, such as a paint sprayer 2; therefore the present invention will be described for a paint sprayer, such as a gravity-feed paint sprayer 2 for use in applying paint 1 to coat substrate surfaces. In one embodiment, paint sprayer 2 is used in the automotive refinishing market, such as automobile body shops, for repainting automobiles.

Although adapter 10 is described herein for a paint sprayer 2, it alternatively can be used for supplying other flowable fluids, such as beverages, foods, or condiments (such as ketchup), gasoline, petrochemicals and hydrocarbons, water, water-based solutions, solvent-based solutions, emulsions, and adhesives. Container 12 and adapter 10 must be compatible with the fluid being supplied, and the fluid should flow out of the container in a similar manner as paint from paint container 12.

Figure 2:
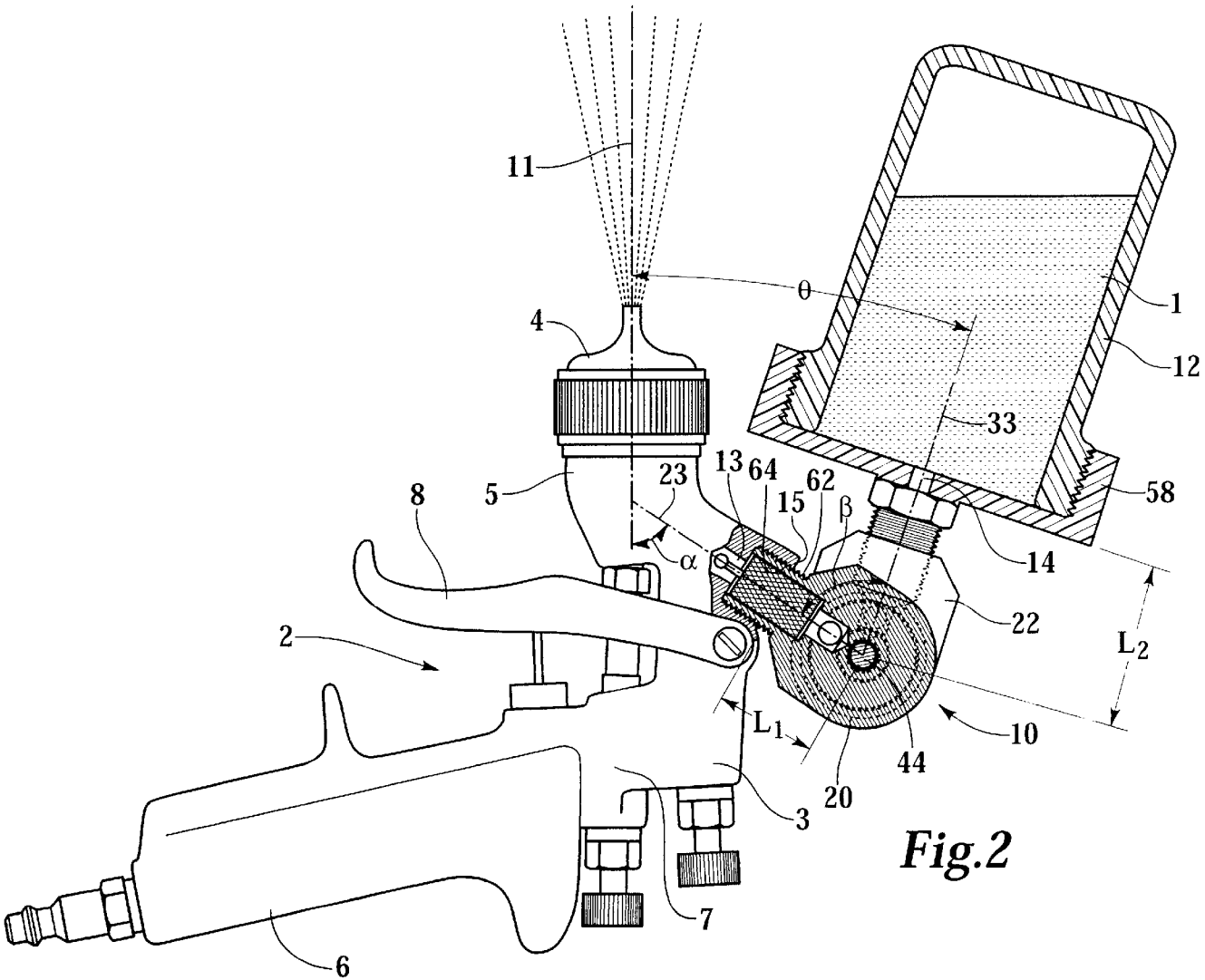
FIG. 2 is a partial side sectional view of the adjustable adapter in an upside down mode engaged with the container and the paint sprayer.

A paint sprayer 2 is shown in FIGS. 1 and 2 and includes a body 3, a nozzle assembly 4 secured to a front end 5 of body 3, and a handle 6 depending from a rear end 7 of body 3. A trigger 8 is pivotally secured to body 3 for the manual actuation of sprayer 2. A top mounted, gravity-feed paint container 12 is mounted to body 3 via adapter 10 near front end 5 for feeding paint to nozzle assembly 4. An air connector 9 is connected to an air hose (not shown) for the delivery of pressurized air to nozzle assembly 4, wherein the delivery of pressurized air is controlled by trigger 8.

Compressed air from air connector 9 is delivered through an internal passage (not shown) to nozzle assembly 4. The compressed air acts to atomize paint and deliver it through nozzle assembly 4 to spray paint 1 about a spray axis 11. Paint 1 is delivered to nozzle assembly 4 via gravity from paint container 12. The level of paint 1 in paint container 12 must be higher than the sprayer inlet connection channel 13, or else paint 1 will not feed via gravity to the nozzle assembly 4, a condition known as starvation.

In one embodiment, shown in FIGS. 1 and 2, inlet connection channel 13 is aligned along an applicator arm flow axis 23, wherein applicator arm flow axis 23 forms an angle à with respect to spray axis 11. Angle à allows spray axis 11 to be oriented in a level direction and a downward direction, while still supplying paint to inlet connection channel 13. Preferably angle à is between about 45° and about 60° so that sprayer axis can be oriented horizontally or downward while still providing paint 1 via gravity to sprayer 2. In the embodiment shown in FIG. 1, angle à is about 55°.

Container

Continuing with FIG. 1, container 12 is preferably generally cylindrical in shape and has an outlet end 14 with threading 56 for engaging with threading 60 of a lid 58. Container 12 can have an interior volume of between about 8 fluid ounces and about 2.5 gallons, preferably between about 16 fluid ounces and about 2 liters, still more preferably about 1 liter. A one liter generally cylindrical container 12 can have a length of about 4 inches and a diameter of about 6 inches. However, container 12 can have different proportions or geometries. Preferably, the size and shape of container 12 is conducive to the automobile refinishing industry so that sprayer 2 and paint container 12 are not unwieldy or overly heavy for an operator to handle.

Container 12 can be an unlined paint cup, as shown in FIG. 1, or container 12 can be lined (not shown), such as is disclosed in the commonly assigned, co-pending patent application Ser. No. 10/458,478 filed contemporaneously herewith, the disclosure of which is incorporated herein by reference.

Container 12 can engage with an adapter lid 58 to engage container 12 with adapter 10, as shown in FIG. 1, or container 12 can engage directly with the adapter (not shown), such as by threaded engagement between an adapter end with an enlarged diameter to accommodate the diameter of container 12.

Adjustable Adapter

Adjustable adapter 10 of the present invention allows applicator arm 20 and container arm 22 to be rotated into different orientations with respect to one another, as shown in FIGS. 1 and 2, to ensure that container 12 is in an upright operative position so paint 1 will flow via gravity into inlet channel 13 of sprayer 2. Adapter 10 can be rotated between an aligned or conventional spraying mode, as shown in FIG. 1, where fluid is sprayed generally parallel to the ground or at a downward trajectory, and an angled or upside-down spraying mode, shown in FIG. 2, wherein fluid is sprayed generally upward. Because adapter 10 can be adjusted to different spraying modes, it ensures that container 12 will be upright so that fluid will continue to flow into fluid applicator 2 due to gravity.

Turning to FIG. 1, when adapter 10 is in the conventional mode, applicator arm 20 and container arm 22 are preferably not angled with respect to one another so that applicator arm flow axis 23 is generally aligned with container arm flow axis 33 so that container outlet 14 is vertically above inlet connection channel 13, so that paint 1 will flow via gravity through adapter 10 and into sprayer 2.

Turning to FIG. 2, container arm 22 can be rotated with respect to applicator arm 20 into the upside down mode when fastener 44 is in the rotation-permitting mode, described below. When in the upside down mode, container arm flow axis 33 forms an angle à with respect to applicator arm flow axis 23. Preferably, angle à is small enough to ensure that container outlet 14 is above inlet channel 13, but not so small that adapter lid 58 comes into contact with sprayer 2 or interferes with paint spraying out of sprayer 2. In one embodiment, angle à is between about 60° and about 90°, preferably about 75°.

In the upside down mode, container arm 22 is angled from the conventional mode so that container 12 is generally upright, as shown in FIG. 2. Container arm flow axis 33 forms an angle è with respect to sprayer axis 11 which is preferably as small as possible without causing interference between sprayer 2 and adapter lid 58 or container 12. Angle è should be between about 0°, wherein spray axis 11 and container arm flow axis 33 are generally parallel, and about 45°, preferably about 20°.

The lengths of applicator arm 20 and container arm 22 should be chosen so that container 12 will be in a desired location. The length $L_1$ of applicator arm 20 between the end 15 of sprayer inlet 13 and fastener 44 should be long enough so that container arm 22 is clear from sprayer inlet end 15. The length $L_2$ of container arm 22 between fastener 44 and container outlet 14 should be long enough to clear adapter lid 58 and container 12 from inlet end 15 so that container arm 22 can be rotated into the upside down mode without interference between sprayer 2 and container arm 22, adapter lid 58 or container 12. However, lengths $L_1$ and $L_2$ should not be so long as to be unwieldy for an operator. Further, length $L_2$ of container arm 22 should be short enough that adapter lid 58 or container 12 will not interfere with paint 1 being sprayed from sprayer 2.

Applicator Arm

Turning to FIG. 3, in one embodiment, applicator arm 20 includes an axis 16, an axial bore 24 for receiving fastener 44, an end 30 for connection to paint sprayer 2, a surface 26 with an opening 28 in applicator arm surface 26, and a passageway 32 for fluid communication between inlet 13 of sprayer 2 and applicator arm opening 28.

Applicator arm end 30 includes threads 62 for engaging with threads 64 of sprayer inlet channel 13, shown in FIG. 1. Preferably, threads 62 are of a typical size and pitch for paint sprayers so that adapter 10 can be used with any of several sprayers. In a preferred embodiment, threads 62 are male for engaging with female threads 64 of inlet connection channel 13. In one embodiment, the diameter of threads 62 of applicator arm end 30 is between about ½ inches and about 1 inch, preferably about ¾ inches.

Figure 4:
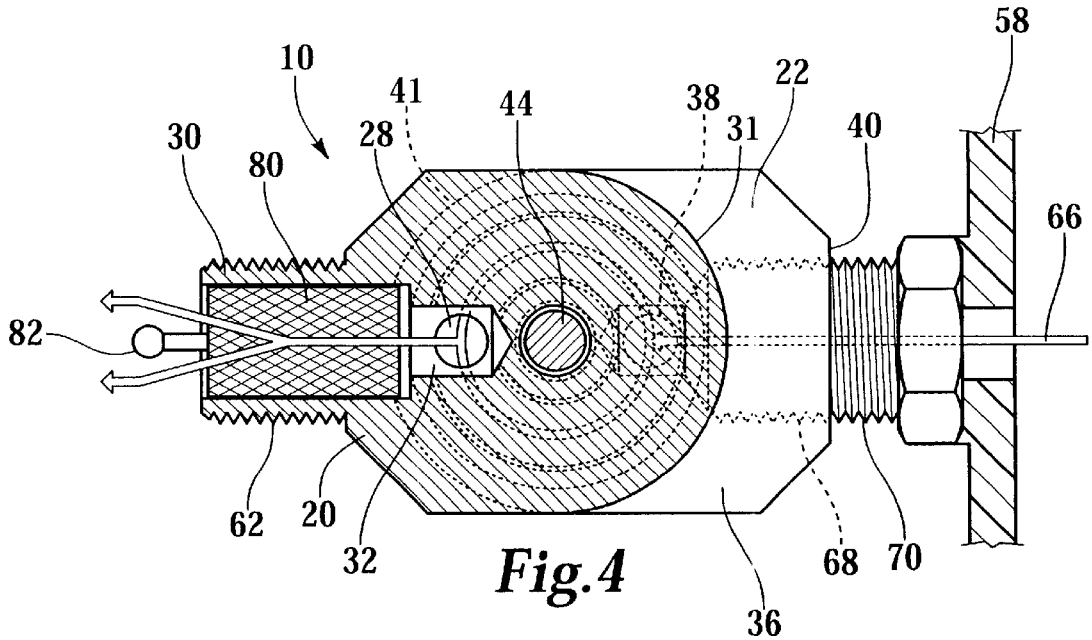
FIG. 4 is a sectional view of the adjustable adapter of the present invention taken along the section line 4—4 in FIG. 3.
Figure 6:
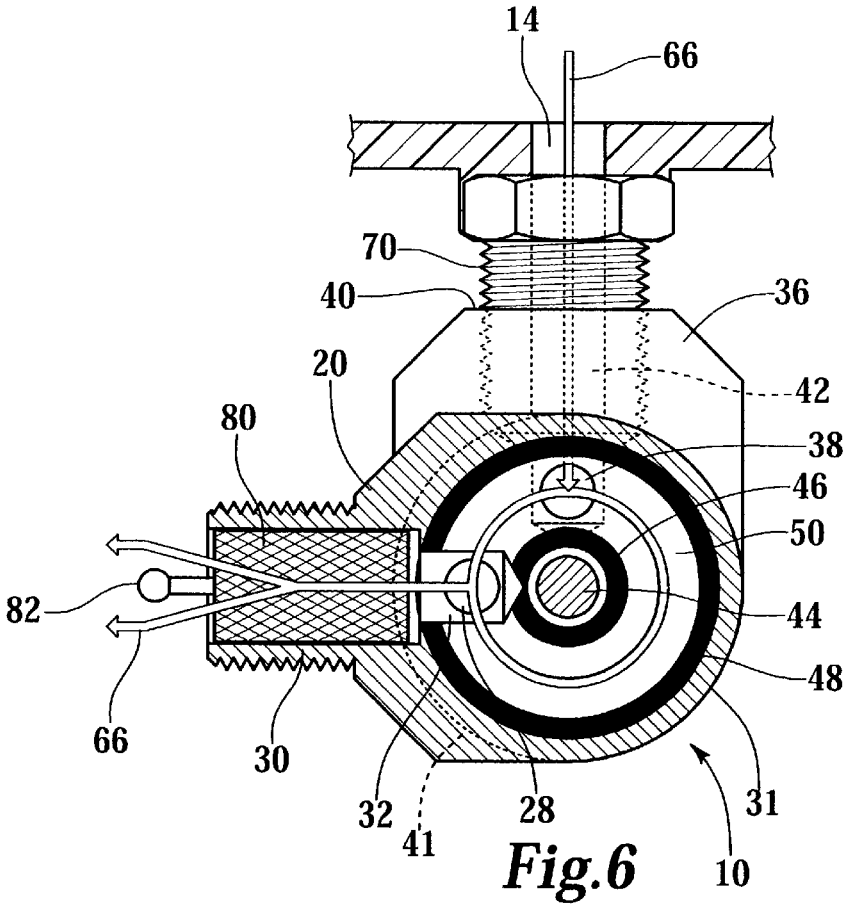
FIG. 6 is a sectional view of the adjustable adapter in the upside down mode showing the paint flow path.
Figure 7:
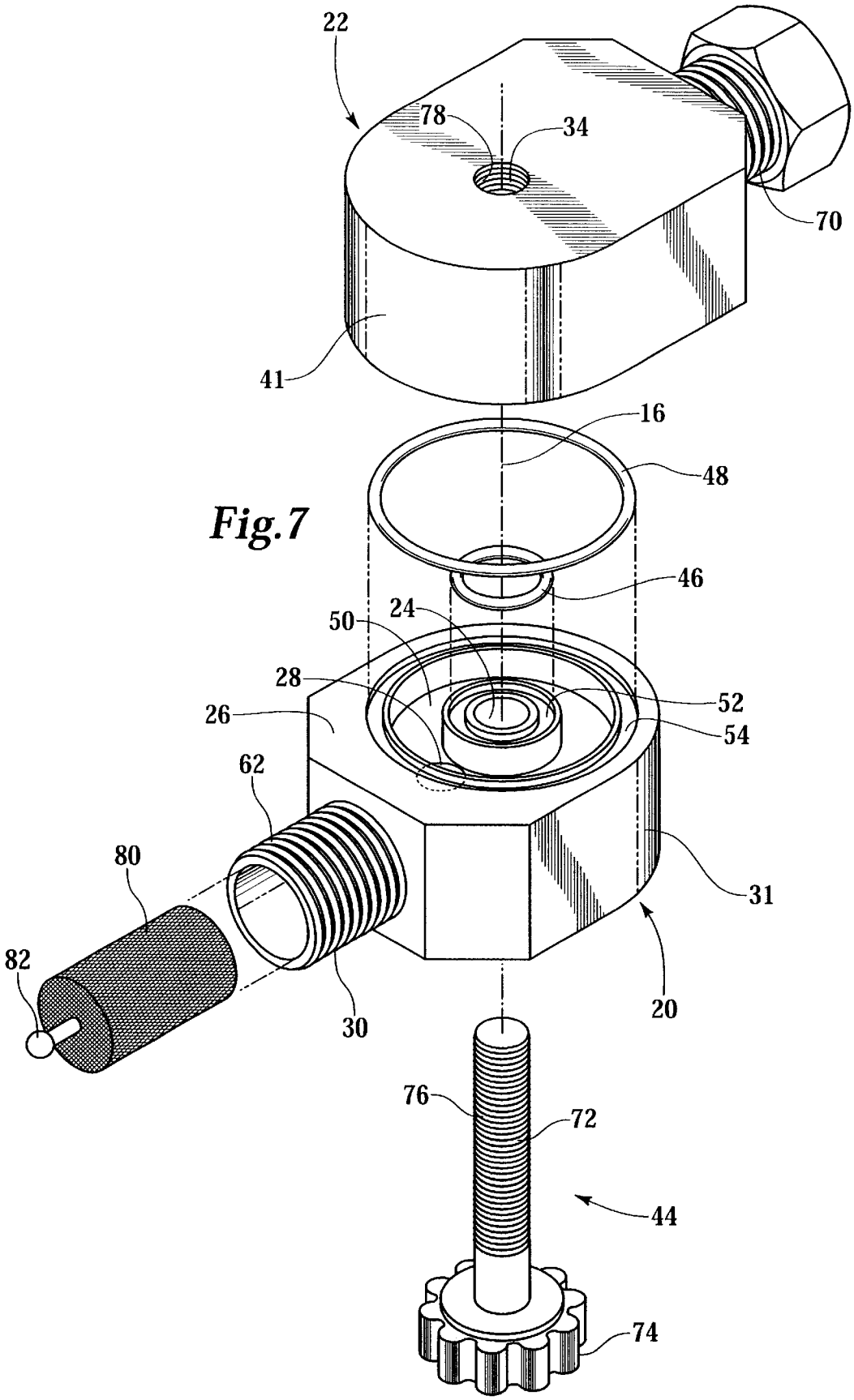
FIG. 7 is an exploded perspective view of the adjustable adapter.

In one embodiment, best seen in FIGS. 4 and 7, applicator arm 20 is chamfered at end 30 and includes a rounded end 31 opposite connection end 30. The chamfers and rounded end 31 prevent the edges of applicator arm 20 from substantially extending past the edge of container arm 22 as arms 20, 22 are rotated with respect to each other, as can be seen in FIG. 6, so that the edges will not interfere with an operator's work. Rounded end 31 can also be chamfered similar to the chamfers at end 30.

Container Arm

Continuing with FIG. 3, in one embodiment, container arm 22 is coaxial with axis 16 and includes an axial bore 34 aligned with applicator arm bore 24, an end 40 for connecting to container 12, a surface 36 having an opening 38, and a passageway 42 for fluid communication between container arm opening 38 and container outlet 14.

In one embodiment, container arm 22 includes threads 68 at container arm end 40 for threaded connection to outlet 14 of container 12. Threads 68 can engage directly with a threaded container (not shown), or threads 68 can engage with threads 70 of an adapter lid 58, which engages with container 12 via threading 60 on adapter lid 58 and threading 56 on container 12. In a preferred embodiment, shown in FIG. 3, threaded end 40 of container arm 22 comprises female threads 68 that engage with male threads 70 on adapter lid 58. Preferably threads 68 are of a typical size and pitch for adapters and containers of paint sprayers, so that adapter 10 can be used with any of several other adapters, adapter lids and containers. The diameter of threads 68 of container arm end 40 can be between about ½ inches and about 1 inch, preferably about ¾ inches.

Container arm end 40 can engage with container 12 and applicator arm end 30 can engage with sprayer 2 by other connection means than a threaded connection, such as a bayonet connection, a snap engagement, or a self-locking taper engagement between the inlet connection and the container (not shown). Novel self-locking tapered connections are described in more detail in the commonly assigned, co-pending patent application Ser. No. 10/458,436 filed contemporaneously herewith, the disclosure of which is incorporated herein by reference.

Like applicator arm 20, container arm 22 can also have chamfers at end 40, best seen in FIG. 3, and a rounded end 41, shown in FIG. 7, to prevent edges of the container arm 22 from extending substantially past the edges of applicator arm 20.

Applicator arm surfaces 26 and container arm surface 36 are substantially normal to axis 16, and preferably are in close proximity to one another for sealing of seals 46, 48, described below. In one embodiment, surfaces 26 and 36 are generally planar, are parallel to one another, and may abut against each other to provide direct friction between surfaces 26 and 36, described below.

Annular Groove

Continuing with FIGS. 3 and 7, one of surfaces 26, 36 includes a groove 50, preferably generally annular in shape, in fluid communication with both openings 28, 38, wherein annular groove 50 is spaced radially from bores 24, 34. In one embodiment, best seen in FIG. 7, annular groove 50 is in surface 26 of applicator arm 20. Alternatively, annular groove 50 can be formed in container arm surface 36, or each surface 26, 36 can include a matching annular groove, wherein the matching annular grooves are aligned with each other.

Figure 5:
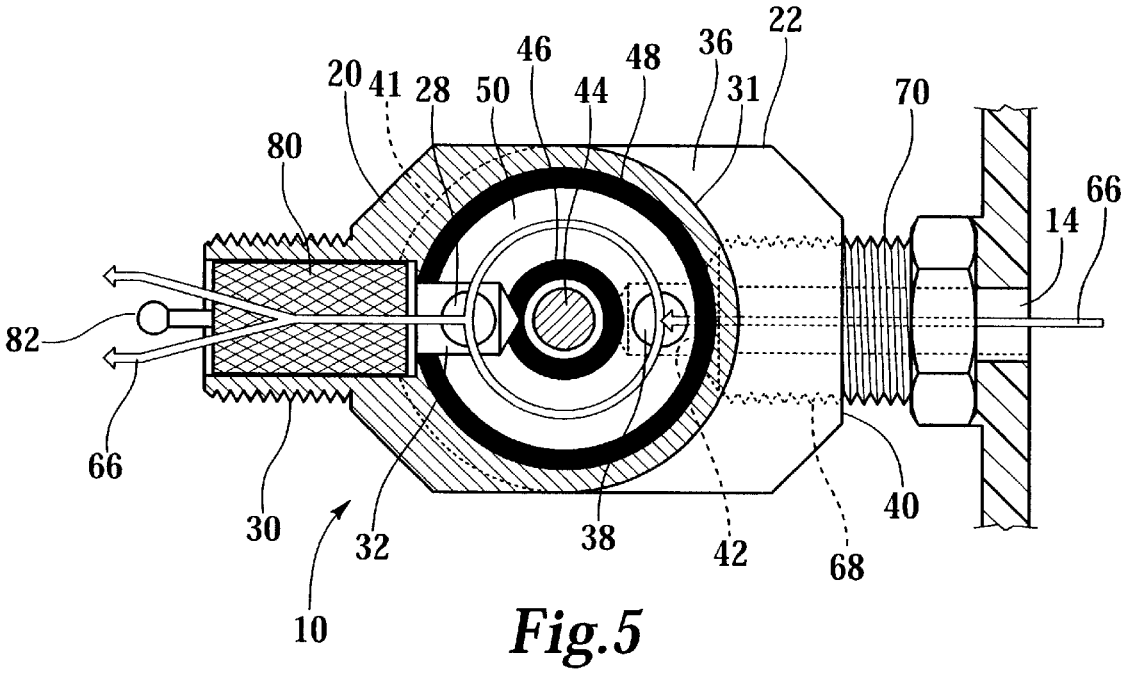
FIG. 5 is a sectional view of the adjustable adapter in the conventional mode showing a paint flow path, taken along the section line 5—5 in FIG. 3.

Annular groove 50 provides a flow path 66, best seen in FIGS. 3, 5, and 6, between container arm 22 and applicator arm 20. Flow path 66 flows from outlet 14 of paint container 12, through container arm passageway 42, through container arm opening 38, around annular groove 50, through applicator arm opening 28, through applicator arm passageway 32 and into inlet connection channel 13 of paint sprayer 2, shown in FIG. 1. Passageways 32, 42, openings 28, 38 and annular groove 50 should be sized to permit a predetermined flow rate of paint through adapter 10.

Seals

Groove 50 is sealed to prevent leakage of fluid from between surfaces 26, 36. In one embodiment, groove 50 is sealed with an inner seal 46 and an outer seal 48. Inner seal 46 is positioned between annular groove 50 and bores 24, 34 and outer seal 48 is positioned outside of annular groove 30 to prevent leakage of paint from annular groove 50. Seals 46, 48 preferably are generally annular in shape so that they frame annular groove 50. Leakage of paint from connections is a common problem, and it is important that annular groove 50 be isolated and sealed.

Seals 46, 48 may be any type capable of forming a reliable, pressure-tight seal between applicator arm 20 and container arm 22, but it is preferred that seals 46, 48 be of a type that allows for sliding movement of arms 20, 22 along seals 46, 48 when the arms 20, 22 are rotated with respect to each other, while still providing for sufficient friction against surfaces 26, 36 to resist rotation when fastener 44 is in the rotation resisting mode, described below. Seals 46, 48 should also be chemically resistant to the fluid flowing through adapter 10. For example, if paint is being supplied to sprayer 2, seals 26, 36 should be chemically resistant to any solvents or other chemicals in the paint. An example of an acceptable seal 46, 48 is an elastomeric annular O-ring, or set of O-rings engaged between container arm 22 and applicator arm 20. O-rings are preferred because of their reliability, and because they are easy to replace and maintain.

In the embodiment shown in FIGS. 3 and 7, annular seals 46, 48 are compressed between applicator arm 20 and container arm 22 by tightening fastener 44, described below, to form a seal between surfaces 26 and 36, preventing paint leakage from adapter 10. Preferably, seals 46, 48 are compressed between about 30% and about 50% of their uncompressed thickness between applicator arm 20 and container arm 22 to ensure a complete seal is formed around annular groove 50. However, it has been found that as little as about 10% compression of seals 46, 48 still provides an adequate seal for most applications. As fastener 44 is tightened more and more, seals 46, 48 are compressed more and more between applicator arm 20 and container arm 22 until applicator arm surface 26 may abut against container arm surface 36, providing a tight seal around the circumference of each seal 30, 32.

Seats

In one embodiment, best seen in FIG. 7, an inner annular seat 52 is located at applicator arm surface 26 to position and retain inner annular seal 46 in the desired radial position between annular groove 50 and bores 24, 34. Applicator arm surface 26 also includes outer annular seat 54 to position and retain outer annular seal 48 in the desired radial position outside of annular groove 50.

In a preferred embodiment, wherein seals 46, 48 are O-ring type seals, annular seats 52, 54 are generally annular grooves, best seen in FIG. 7. The grooves of annular seats 52, 54 are preferably substantially less deep than annular groove 50 so that annular seats 52, 54 merely retain seals 46, 48 but do not conceal them. Preferably, the depths of annular seats or grooves 52, 54 are between about ¼ and about ¾ of the thickness of uncompressed seals 46, 48, preferably about ½, so that a portion of seals 46, 48 will rise above applicator arm surface 26 and contact container arm surface 36 for sealing between annular seats 52, 54 and container arm surface 36.

Inner annular seat 52 and outer annular seat 54 can be provided at either applicator arm surface 26 or container arm surface 36, or seats 52, 54 can each be provided at a different surface. Further, seats 52, 54 can be at the same surface as annular groove 50, as in FIG. 7, both seats 52, 54 can be at the opposite surface as annular groove 50, or one seat can be at the same surface as annular groove 50, and the other seat can be on the opposite surface. Alternatively, each surface 26, 36 can have their own matching inner seat and matching outer seat, wherein the inner seats are aligned and the outer seats are aligned. The locations of seats 52, 54 should provide for a proper seal to be formed around annular groove 50 to prevent leakage of paint from adapter 10.

In a preferred embodiment, best seen in FIG. 7, applicator arm surface 26 includes all three grooves, annular groove 50, inner annular seat or groove 52, and outer annular seat or groove 54. The three grooves 50, 52, 54 are preferably generally concentric about axis 16 and spaced radially from each other and from applicator arm bore 24, wherein annular groove 50 is the middle groove and is in fluid communication with applicator arm opening 28 and container arm opening 38, inner annular seal 46 is placed within the inner groove or annular seat 52, and outer annular seal 48 is placed within the outer groove or annular seat 54.

Fastener

Coaxial fastener 44 pivotally couples applicator arm 20 and container arm 22. In the embodiment shown in FIG. 3, applicator arm bore 24 and container arm bore 34 receive fastener 44 to pivotally couple applicator arm 20 to container arm 22. Fastener 44 extends through bores 24, 34 so that fastener 44 is coaxial with axis 16.

In the embodiment shown in FIGS. 3 and 7, fastener 44 is a locking bolt having a shank 72, a head 74 at one end of shank 72 and threads 76 at the other end of shank 72. In a preferred embodiment, head 74 is a thumbscrew, shown best in FIG. 7, so that fastener 44 can be manually adjusted by an operator.

Fastener threads 76 can engage with a nut (not shown) or threads 76 can engage with threading 78 in one of the bores 24, 34. In the embodiment shown in FIG. 3, fastener threads 76 engage with threading 78 of threaded bore 34 in container arm 22 and shank 72 is inserted first through applicator arm bore 24 and then through container arm bore 34 so that head 74 abuts applicator arm 20, as shown in FIG. 3. In this embodiment, applicator arm bore 24 has an inner diameter that is larger than the outer diameter of shank 72 and threads 76 so that applicator arm 20 is free to rotate around shank 72 or so that fastener shank 72 is free to rotate within applicator arm bore 24.

Fastener 44 is movable between a rotation-resisting mode and a rotation-permitting mode. When fastener 44 is in the rotation-resisting mode, fastener 44 forces container arm surface 36 and applicator arm surface 26 toward one another sufficiently to increase friction at surfaces 26, 36 to resist rotation between container arm surface 36 and applicator arm surface 26, which in turn prevents rotation of applicator arm 20 with respect to container arm 22, locking adapter 10 in the desired spraying mode.

Friction between surfaces 26, 36 can be indirect, such as transmission from container arm surface 36 through seals 46, 48 to applicator arm surface 26, wherein the compression of seals 46, 48 acts both to seal around annular groove 50 and to brake surfaces 26, 36. Alternatively, the friction can be direct, such as metal-to-metal friction between applicator arm surface 26 and container arm surface 36. Preferably, the friction between surfaces 26 and 36 is both indirectly through seals 46, 48 and through direct contact between surfaces 26, 36. Most of the friction that resists rotation of surfaces 26, 36 with respect to one another is created between surfaces 26, 36 and seals 46, 48.

When fastener 44 is in the rotation-permitting mode, fastener 44 releases applicator arm surface 26 and container arm surface 36 sufficiently to decrease friction between surfaces 26 and 36 and between seals 46, 48 and surfaces 26, 36, permitting rotation between container arm surface 36 and applicator arm surface 26, allowing applicator arm 20 and container arm 22 to rotate freely about axis 16 in order to adjust adapter 10 between the conventional mode shown in FIGS. 1 and 5 and the upside-down mode shown in FIGS. 2 and 6.

When fastener 44 is in the rotation-permitting mode, seals 46, 48 are not tightly compressed between applicator arm 20 and container arm 22, decreasing the friction, particular between arms 20, 22 and seals 46, 48. Decreased friction at surfaces 26, 36 allow applicator arm 20 to rotate freely about fastener.

In a preferred embodiment, fastener 44 is moved between the rotation-resisting mode and the rotation-permitting mode by rotating fastener 44 so that threads 76 engage bore threading 78, driving head 74 toward container arm 22 and causing head 74 to move applicator arm 20 toward container arm 22 to compress seals 46, 48 between arms 20, 22, increasing the friction at surfaces 26, 36. Preferably, fastener threads 76 and bore threading 78 are configured so that an operator turns thumbscrew head 74 in a clockwise direction to engage fastener threads 76 with bore threading 78 to move fastener 44 into the rotation-resisting mode and so that an operator turns thumbscrew head 74 in a counterclockwise direction to move fastener 44 out of the rotation-resisting mode and into the rotation-permitting mode. Clockwise rotation for engagement and counterclockwise rotation for disengagement is preferred because these directions are conventional and will be readily understood by operators of paint sprayer 2.

Filter

Turning to FIG. 3, adapter 10 can include a filter 80 in one of the passageways 32, 42 to filter impurities, such as dust or other particulates, from flowing into sprayer 2 so that the impurities will not be applied to the surface being painted. Filter 80 can be located in either applicator arm passageway 32, as shown in FIG. 1, or in container arm passageway 42 (not shown). It is preferred that filter 80 be in applicator arm passageway 32 so that filter 80 will be as close to nozzle assembly 4 as possible. Filter 80 is preferably removable, such as with a small handle 82, so that filter 80 may be cleaned or replaced if it becomes worn or soiled. An example of a filter that can be used is the model KGP-5-K5 filter manufactured by ITW DeVilbiss Automotive Refinishing.

The adjustable adapter of the present invention can be used with a gravity-feed fluid applicator to prevent starvation of fluid, even if the applicator is used in various orientations.

While the foregoing written description of the invention enables one of ordinary skill to make and use what is considered presently to be the best mode thereof, those of ordinary skill will understand and appreciate the existence of variations, combinations, and equivalents of the specific exemplary embodiment herein. The invention should therefore not be limited by the above described embodiment, but by all embodiments within the scope and spirit of the invention.

What is claimed is:

1. An adjustable adapter for connecting a container having an outlet and an applicator having an inlet, comprising:

a first arm having an axis, a surface generally normal to said axis with a fluid opening, an end for connection to said inlet of said applicator, and a passageway for fluid communication between said first arm surface opening and said applicator;

a second arm coaxial with said first arm having a surface generally normal to said axis with a fluid opening, said second arm surface facing said first arm surface, an end for connection to said outlet of said container, and a passageway for fluid communication between said second arm surface opening and said container; and a coaxial fastener for pivotally coupling said arms;

wherein at least one of said surfaces is provided with a groove in fluid communication with said surface openings, said groove being sealed to prevent fluid from leaking from between said surfaces;

wherein, when in a rotation-resisting mode, said fastener forces said surfaces toward one another sufficiently to increase friction and resist rotation therebetween and, when in a rotation-permitting mode, said fastener releases said surfaces sufficiently to decrease friction and permit rotation therebetween.

2. An adjustable adapter according to claim 1, further comprising a filter in one of said passageways.

3. An adjustable adapter according to claim 1, wherein said first arm is rotatable relative to said second arm between a conventional mode and an upside-down mode when said fastener is in the rotation-permitting mode.

4. An adjustable adapter for connecting a container having an outlet and an applicator having an inlet, comprising:

a first arm having an axis, an axial bore, a surface normal to said axis with a fluid opening, an end for connection to said inlet of said applicator, and a passageway for fluid communication between said first arm surface opening and said applicator;

a second arm coaxial with said first arm having an axial bore aligned with said first arm bore, a surface normal to said axis with a fluid opening, said second arm surface facing said first arm surface, an end for connection to said outlet of said container, and a passageway for fluid communication between said second arm surface opening and said container;

a fastener extending through said bores; and an inner seal and an outer seal;

wherein at least one of said surfaces is provided an annular groove spaced radially from said bores, said at least one annular groove being in fluid communication with said surface openings;

wherein said inner seal is positioned between said bores and said at least one annular groove and said outer seal is positioned outside said at least one annular groove; and wherein, when in a rotation-resisting mode, said fastener forces said surfaces of said arms toward one another sufficiently to increase friction and resist rotation therebetween and, when in a rotation-permitting mode, said fastener releases said surfaces sufficiently to decrease friction and permit rotation therebetween.

5. An adjustable adapter for connecting a container having a threaded outlet and an applicator having a threaded inlet, comprising:

a first arm having an axis, an axial bore, a generally planar surface normal to said axis with a fluid opening, a threaded end for threaded connection to said threaded inlet of said applicator, and a passageway for fluid communication between said first arm surface opening and said applicator;

a second arm coaxial with said first arm having an axial bore aligned with said first arm bore, a generally planar surface normal to said axis with a fluid opening, said second arm surface facing said first arm surface, a threaded end for threaded connection to said threaded outlet of said container, and a passageway for fluid communication between said second arm surface opening and said container;

a fastener having a shank with a thumbscrew at one end and threads at the other end, said shank extending through said bores and threadingly engaging the one of said bores farthest from said thumbscrew, said one bore being threaded; and an inner annular seal and an outer annular seal;

wherein one of said surfaces is provided with three concentric annular grooves spaced radially from each other and from the bore of said one surface, the middle annular groove being in fluid communication with said surface openings;

wherein said inner annular seal is positioned in the inner annular groove and said outer annular seal is positioned in the outer annular groove;

wherein, when in a rotation-resisting mode, said thumbscrew of said fastener is turned clockwise to force said surfaces of said arms toward one another to increase friction between said surfaces and resist rotation therebetween, when in a rotation-permitting mode, said thumbscrew of said fastener is turned counterclockwise to decrease friction between said surfaces and permit rotation therebetween.

6. An adjustable adapter according to claim 5, further comprising a filter in one of said passageways.

* * * * *